US005121434A

United States Patent [19]

Mrayati et al.

[11] Patent Number: 5,121,434

[45] Date of Patent: Jun. 9, 1992

[54] SPEECH ANALYZER AND SYNTHESIZER USING VOCAL TRACT SIMULATION

[75] Inventors: Mohamad Mrayati, Damas, Syria; René Carre, Grenoble; Bernard Guerin, Saint Jean De Moirans, both of France

[73] Assignee: Centre National de la Recherche Scientifique, Paris, France

[21] Appl. No.: 365,566

[22] Filed: Jun. 14, 1989

[30] Foreign Application Priority Data

Jun. 14, 1988 [FR] France ..... 88 08255

[51] Int. Cl.[5] ..... G10L 7/02

[52] U.S. Cl. ..... 381/53; 381/51

[58] Field of Search ..... 381/36-39, 381/41, 51-53

[56] References Cited

U.S. PATENT DOCUMENTS

| | | | |
|---|---|---|---|
| 3,280,266 | 10/1966 | Flanagan | 381/51 |
| 3,472,964 | 10/1969 | Hogue | 381/53 |
| 4,109,103 | 8/1978 | Zagoruiko et al. | 381/53 |
| 4,542,524 | 9/1985 | Laine | 381/53 |

OTHER PUBLICATIONS

Parsons, Thomas, *Voice and Speech Processing*, 1986, McGraw-Hill Inc., pp. 100-135.

G. Fant, *Acoustic Theory of Speech Production*, 1960, pp. 26-41 and 62-90.

J. Flanagan, *Speech Analysis Synthesis and Perception*, 1972, pp. 58-85.

Frank et al., *Improved Vocal Tract Models for Speech Synthesis*, IEEE 1986, pp. 2011-2014.

E. David, *Signal Theory in Speech Transmission*, IRE Transactions on Circuit Theory, Dec. 1956, pp. 232-244.

H. K. Dunn, *The Calculation of Vowel Resonances, and an Electrical Vocal Tract*, The Journal of the Acoustical Society of America, vol. 22, No. 6, Nov. 1950, pp. 740-753.

*Primary Examiner*—Dale M. Shaw
*Assistant Examiner*—Michelle Doerrler
*Attorney, Agent, or Firm*—Lowe, Price, LeBlanc & Becker

[57] ABSTRACT

A speech analyzer and synthesizer uses simulation of the acoustic behavior of a tube divided into portions having variable sections. The section variations of the various portions of the tube generate sounds corresponding to voiced phonemes when an air flow and pressure source is positioned in analogy with human vocal cords. Using simulation techniques, it is possible to generate the phonemes in the form of electric signals supplied to a loud-speaker. The selection of tube portion lengths correlates to the accuracy of the approximation desired. For a three-formant approximation (formants are the tube resonance frequencies), the tube is divided into eight portions having successive lengths, L/10, L/15, 2L/15, 3L/15, 3L/15, 2L/15, L/15 and L/10, where L is the overall length of the tube.

4 Claims, 3 Drawing Sheets

SPEECH ANALYZER AND SYNTHESIZER USING VOCAL TRACT SIMULATION

BACKGROUND OF THE INVENTION

The present invention relates to speech analyzing, synthesizing and coding.

The analyzing, synthesizing and coding processes of human speech encounter major difficulties resulting from the high complexity of the frequency spectrum of the produced sounds, spectrum closeness of resembling phonemes, the number of different phonemes used in a same language and a fortiori in different languages and dialects, and mainly the plurality of ways the sounds are actually formed as a function of the preceding or following sounds (co-utterance phenomena). It is therefore extremely difficult either to (i) identify a train of phonemes generated at a high rate for reconstituting the words that were spoken or (ii) to synthesize trains of sounds and words that will be effectively identified together with their meaning by those who hear them.

A well-known process for speech synthesizing consists in using a device simulating the behaviour of an acoustic tube having a variable cross sectional area representing the vocal tract through which human speech is produced. The vocal tract starting with the vocal cords (that act as an excitation source at the upstream extremity of the tube) extends from the larynx to the lips, through the pharynx, and the buccal cavity. The vocal tract forms a conduit having a variable cross sectional area over the length of the conduit. Cross sectional area of the vocal tract varies over a large range, and is approximately 2 $cm^2$ in the larynx, from 3 to 7 $cm^2$ in the from 0 to 15 $cm^2$ in the buccal cavity, 0 $cm^2$ at the lips if they are closed, etc.

This vocal tract can be represented as an acoustic tube constituted by a series of individual portions having a constant length, the cross sectional area of which has a determined value at rest. The works of G. FANT, Acoustic Theory of Speech Production, 1960, Mouton and Co, Gravenhage, Netherlands, and J.L. FLANAGAN, Speech Analysis Synthesis and Perception, 1972, Springer-Verlag, New York, refer to this type of representation wherein the vocal tract is divided into successive portions of about one centimeter in length, the cross sectional areas of which can be classified. The sound production can be expressed as a function of the cross sectional areas of the individual sections. It is It is possible to produce sounds recognizable as human speech phonemes by using a train of acoustic tube portions provided with an air flow source at the input, this source exhibiting characteristics similar to those of human vocal cords, and by causing the cross sectional areas of the various portions to vary.

With the advent of modern computer signal processing techniques, it is not necessary to construct a physical acoustic tube with mechanically cross variable sectional areas. Instead air source and vocal tract simulation using either analog electric circuits or a digital computer wherein one is able to vary parameters representing especially the tube cross sectional areas, the overall tube length, and the air flow spectrum from the source.

At the output, the computer supplies a loudspeaker (for speech synthesis) with an electric signal, the spectrum and spectrum variations of which reproduce as faithfully as possible the spectrum and spectrum variations of the sound or sound train it is desired to generate. For speech analysis, a microphone receives the acoustic message and converts it into electric signals, received and processed by the computer, for example after analog/digital conversions. The analysis result can be used directly in a speech recognition mode or can be coded and transmitted for speech reconstitution. Coding can be a scalar or vectorial type.

Although the principle of the vocal tract simulation by means of a series of acoustic tube portions, each having a variable cross sectional area, is known, it has never been implemented in a satisfactory way to permit analysis or synthesis of continuous speech. Most often, attempts are made for example for vowels or consonant/vowel sets ; but it has thus far not been possible to synthesize or identify trains of sounds such as produced by human speech.

This is because the automatic control from text is difficult and not well known. The voice tract acoustic tube has to take a high number of parameters into account : there are many tube portions, the cross sectional areas of each portion can present important variations (when articulating "a" or "o" it is clearly seen that the air flow volume between the lips varies) and, if one calls "surface function" the curve of the cross sectional area values of the tube portions along the successive portions, there is no direct relationship between the surface functions of the acoustic tube and the sounds produced.

On the other hand, the sound spectra generated by human speech are characterized by "formants" (which are successive maxima present in the spectrum : first formant for the lowest resonance frequency, second formant, third formant, etc.). Those formants represent the resonances of the vocal tract, i.e., resonances which modulate the spectrum of the sound source (vocal cords) resulting in a modulated spectrum at the vocal tract output. Vowels for example are characterized by constant values of the formant frequencies (that is, the frequency values of the spectrum having a maximum amplitude). Consonants are by relative variations in the formant frequencies.

However, the combination of a train of syllables is difficult to express as a function of formant frequency variations because, for one element of the considered train, the formant frequencies depend upon the preceding and following sounds (co-uttering phenomenon).

It has been possible to realize speech synthesizers so-called "formant synthesizers": they use (or simulate) resonant circuits, the resonant frequency of which can be individually controlled. By combining several resonance frequencies corresponding to the formant frepuencies of a particular vowel, this vowel can be synthesized. By causing the circuit resonance frequencies to vary in the same way as the formant frequencies of a consonant, this consonant can be artificially reproduced.

Generally, the knowledge of the first three formants or their variations as a function of time provides a good approximation for analyzing or synthesizing sounds. However it could be sufficient to use two formants for a simplified analysis or synthesis, or on the contrary include up to four formants, and even more, for a more sophisticated analysis or synthesis.

In the formant synthesis mode, one analyzes or reconstitutes signal spectra ,exhibiting amplitude maxima for determined frequencies. However, it is not known how to accurately analyze or reconstitute the whole spectrum and the spectrum variations which exactly determine the constitution of a given sound. The problem is even more complicated if, due to the co-uttering phenomenon between successive vowels and consonants, the spectra, and spectrum variations of the signal are intermixed.

SUMMARY OF THE INVENTION

The present invention is based on conbining speech analyzing and synthesizing proposals using an acoustic tube simulation model with variable cross sectional areas and the knowledge that has been acquired in the formant analysis and synthesis field, for obtaining highly efficient analyzing and synthesizing devices. Their efficiency is due to the fact that they supply a very satisfactory sound representation while reducing the number of representation parameters of those sounds and that they operate according to a mode which seems to be very similar to the operation of human speech.

The invention provides for a speech analyzing, coding or synthesizing apparatus using a device simulating the acoustic behaviour of a tube constituted by a series of N portions having different and variable cross sectional areas, end to end positioned. The set of N portions are divided into subsets of successive ranks, as follows : the set of N portions is divided into two subsets of rank 1, the first subset at an upstream the tube, corresponding to a negative sensitivity to the cross sectional area variations for the first format and the second one to a positive sensitivity. Each subset of rank i is divided in the same way into two subsets of rank $i+1$ if there is a change in the sensitivity sign of formant $i+1$ in that subset, one of the subsets corresponding to a negative sensitivity for the $(i+1)^{th}$ formant and the other one to a positive sensitivity. Each of the subsets of rank $(n-1)$ are divided into two portions, one of the portions corresponding to a negative sensitivity of the $n^{th}$ formant and the other one to a positive sensitivity. The sensitivity of the $i^{th}$ formant to the cross sectional area variations of a tube portion represents the relative variation of the $i^{th}$ formant frequency as a function of an area variation of that portion. The device includes parameters for the analyzing or synthesizing control, on the one hand, the area variations of some of the tube portions thus determined and, on the other hand, the overall length of the tube ; the device receiving signals from a microphone or supplying signals to a loudspeaker when operated in respective speech analyzing or synthesizing modes.

An important factor is the way the acoustic tube is subdivided into successive portions which is correlated with the presence of formants and the sensitivity of those formants to the local section variations of the tube. In the the prior art, the subdivision into portions was either arbitrary or correlated with various data. The invention provides for a very specific subdivision correlated with formants and depending upon the number of formants with which the analyzing or synthesizing approximation has to be carried out. More precisely, if, for example, a twoformant approximation is desired, that is, an approximation similar to that obtained in an analysis, coding or synthesis with two formants but obtained by simulating the behaviour of a tube with successive portions having variable cross sectional areas, the tube will be divided into four portions having relative successive lengths roughly equal to 1/6, ⅓, ⅓, 1/6 (with respect to the overall length of the tube). If a three-formant approximation is desired, a simulation of a tube divided into eight portions of relative successive lengths equal to 3/30, 2/30, 4/30, 6/30, 6/30, 4/30, 2/30, 3/30 will be used.

Details for determining these divisions are presented below.

The theoretical values of tube portion lengths can be precisely calculated, but of course the practical values can only be approximations of the theoretical values without basically changing the speech analyzing or synthesizing overall result.

To determine the sensitivity of formants to cross sectional are variations, the following approximation can be made. The sensitivity function of the formant to the section variations of a portion drawn as a function of the position of this portion between the upstream and downstream extremities of the tube. For the first formant, this function can be approximated as a half sine wave period, the sensitivity being negative and maximum at the upper input of the tube, null in the middle, positive and maximum at the output. "Positive sensitivity" is to be construed as an increase in the formant frequency for an increase in the cross sectional area. A negative sensitivity is a frequency decrease for a cross sectional area increase.

For the second formant, the sensitivity function can be assimilated to three half sine wave periods between the input and the output. For the $i^{th}$ formant, the function can be assimilated to a sine wave, the half period of which is $L/(2i-1)$ where L is the overall length of the tube, the sensitivity being maximum and negative at the upstream input (there are therefore $2i-1$ half periods between the tube input and output for the sensitivity function of the $i^{th}$ formant).

The zero-crossing areas of the various formant sensitivity constitute the boundaries of the successive tube portions There are $N=2+n(n-1)$ portions if an nformant approximation, is chosen.

The physical characteristics of sections of the tube portions of the simulation device can be varied in several ways :

varying the overall cross sectional area of the portion, varying the cross sectional area of a part of a portion placed near the middle of the section (so as to act upon all the formants at a time), varying the cross sectional area of a part of a portion placed near the boundary between two portions (if it is desired to intentionally suppress the action upon one of the formants : the one, the sensitivity of which is cancelled near this boundary).

Owing to this arrangement of the tube portions that are carefully selected, it has been possible to directly correlate human speech analysis and synthesis with formants, minimizing the number of control parameters of the simulation device to generate sounds, the formants and variations of which have been precisely classified.

This arrangement therefore basically differs from the proposals already made in the field of simulation by means of tubes with variable cross sectional areas since, up to now, one merely has artificially subdivided the tubes into portions. Typically, the prior art provided subdivision into regular sections of about 1 cm in length or, by analogy with the vocal tract, subdivision between one larynx and one pharynx region and arbitrary subdivision in the mouth.

BRIEF DESCRIPTION OF THE DRAWINGS

The foregoing and other objects, features, advantages of the invention will be apparent from the following detailed description of preferred embodiments as illustrated in the accompanying drawings wherein.

DETAILED DESCRIPTION OF THE INVENTION

Figure 1:
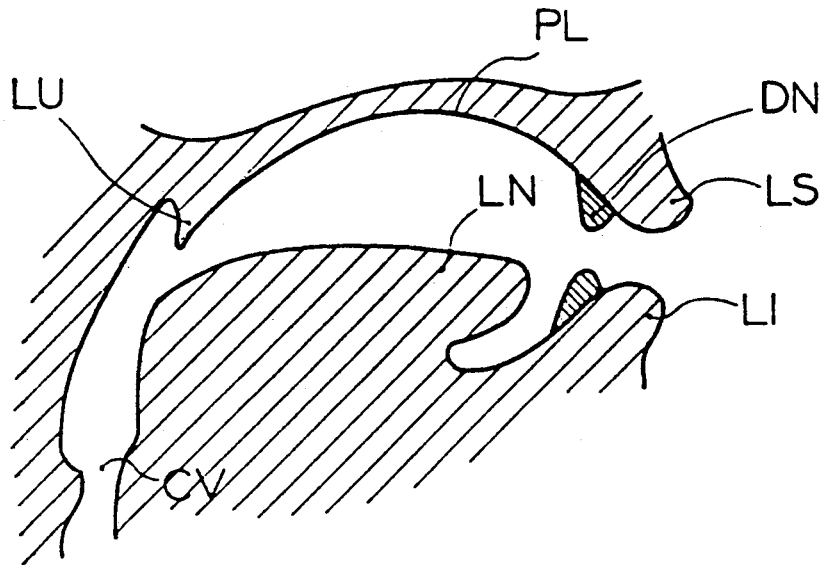
FIG. 1 shows the general shape of a human vocal tract.

FIG. 1 is a cross section view of the simplified anatomy of a human vocal tract with various regions and organs such as vocal cords CV constituting the air flow source (having a very specific periodic wave-shape), uvula LU, palate PL, tongue LN, teeth DN, upper lip LS and lower lip LI.

Figure 2:
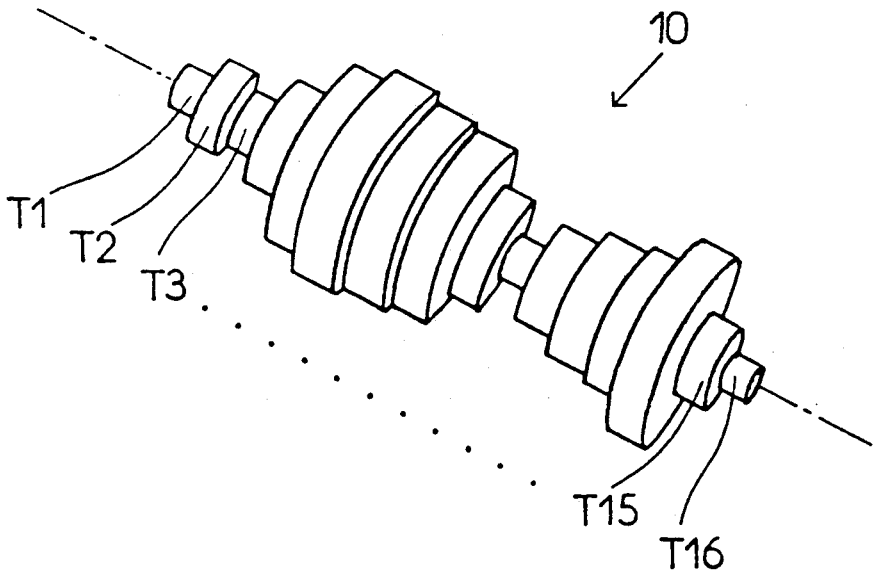
FIG. 2 is a schematic respresentation of this vocal tract in the form of a tube divided into portions with different, individually variable, cross sectional areas.

FIG. 2 is a schematic diagram of a vocal tract that has been achieved in the form of an acoustic tube 10 constituted by cylindric adjacent portions T1, T2 . . . T16, having different cross sectional areas at rest, those areas being liable to vary independently one from the other. The combination of the area variations of the various portions produce different sounds. Vowels mainly correspond to ratios between the various cross sectional areas. Consonants correspond to transitions between a first area combination and a second area combination.

For speech synthesis, the tube is positioned behind an air flow source reproducing the characteristics of vocal cords, that is, especially a periodical flow wave having a period of about 10 milliseconds with a very rounded off saw-tooth shape, the rising edge being slower than the decreasing edge.

Because of the difficulty encountered to mechanically realize such an acoustic tube, one will preferably resort to modern technologies by computer simulation, wherein the behaviour of the acoustic tube can be determined, that is, wherein air flow and pressure can be calculated at each point and especially at the tube output. The characteristics of the electric signals that are to be applied to a loud-speaker for reproducing said flow and pressure are also calculated, and an electric signal exhibiting those characteristics is supplied by a computer controlled sound generator.

Figure 3:
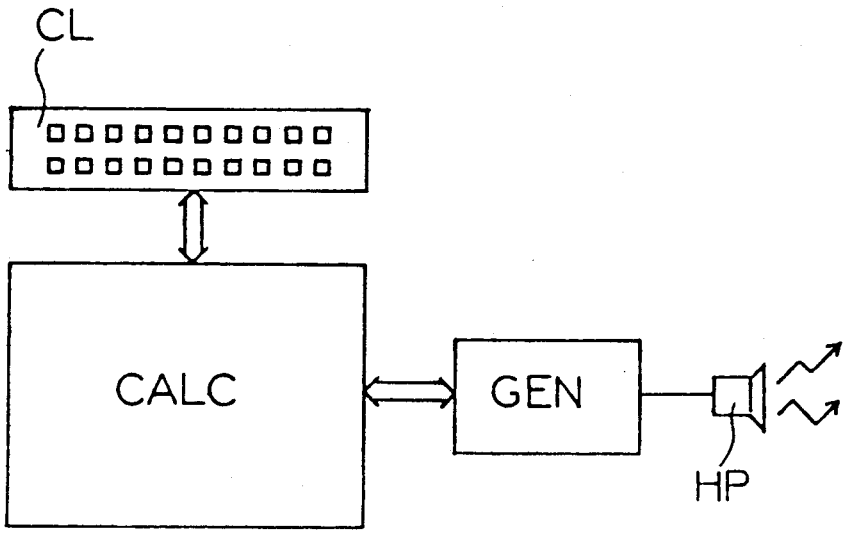
FIG. 3 is a block-diagram of a speech synthesizing device.

FIG. 3 schematically shows this practical embodiment of a speech simulation synthesizer. A data input device determines the series of phonemes to be produced. This device can for example, be an alphanumerical keyboard CL where the keys or key combinations represent phonemes. The resultant data is conventionally applied to the computer CALC in the form of electric signals through a connection bus. The computer controls an electric signal synthesizer (GEN) which in turn controls a loud-speaker HP.

The computer operation is as follows. A series of parameters is generated from the keyboard which correspond to the values of the cross sectional areas of the acoustic tube portions representing the vocal tract and to the variations of those areas as a function of time. Data processing simulates, by means of calculations, the tube behaviour having the specified cross sectional areas and the specified area variations. This behaviour is well known and is described for example in J.L. Flanagan's work as hereinabove mentioned.

Processing firstly provides the air flow and/or pressure values at the tube output, then the electric signals to be applied to a loud-speaker for reproducing the pressure at the output. It can be assumed, for the sake of simplicity, that the air pressure caused by the loud-speaker is proportional to the instantaneous electric current supplied to the speaker. In that case, processing consists in continually determining the wave-shape of the air pressure representing the desired sound. The electric signal synthesizer supplies a drive current wave-shape exactly corresponding to the wave-shape of the calculated air pressure. If the loud-speaker exhibits a nonlinear. air pressure/electric current response curve, this has to be taken into account by the computer.

Since the invention does not relate to speech synthesizing or analyzing principle by simulating the acoustic behaviour of a tube, a principle known per se, but to the selection of the simulation parameters, this selection will now be explained in detail. The selection relates to the portion lengths of the tubes used for data processing.

Parameters stored in the computer are not be the cross sectional area variations of portions of a tube cut into portions of arbitrary lengths (as it is the case in FIG. 2 where, for the sake of simplicity, all the portions have the same length) but represent the area variations of portions having determined lengths resulting from the division according to the invention which will now be explained in detail. A tube having an overall length L (for example 15–20 cm, which corresponds to the vocal tract length) is used. The acoustic response of that tube exhibits formants, that is, more or less marked resonances at given frequencies. The spectrum of an acoustic signal generated at the tube input will be modulated by those formants and will exhibit local maxima at the frequencies of the formants.

Figure 4:
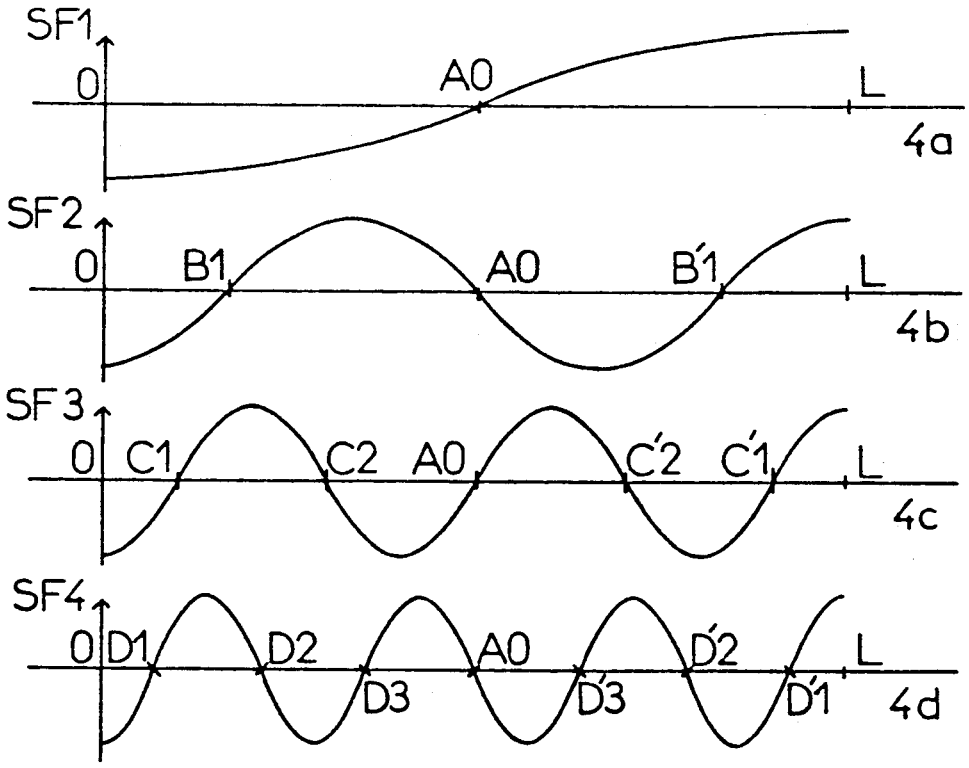
FIG. 4 shows the sensitivity curves of the first four formants of a uniform tube.

The theoretical acoustic study of a tube having a length L shows that the formant frequency varies as a function of the tube cross sectional area, However, it does not vary in the same way everywhere. If the tube cross sectional area is locally varied in the middle of the tube, the format frequency does not vary. If instead, the cross sectional area is varied at the tube input or output, a cross sectional area variation causes the formant frequency to vary. If the cross sectional area varies at the tube input, the formant frequency increases in response to a decrease of the cross sectional area. At the tube output, the formant frequency increases as the cross sectional area increases. If the tube area is varied at a random point, the frequencies of the various formants will vary at different amplitudes and in different directions. Indeed, for a tube initially having a uniform cross sectional area, a theoretical representation of the formant sensitivity can be formulated. The variation direction of the formant frequencies can be determined as a function of a local variation of the tube cross sectional area because the formant sensitivity varies in a sinusoidal fashion along the tube between the input and the output, the sinusoidal period being different for each of the formants. This is illustrated in FIG. 4. Diagram 4*a* shows the sensitivity curve SF1 of the first formant F1 of the tube as a function of the position x (x varying between 0 and L) at which a cross sectional area variation is produced. Diagram 4*b* shows the sensitivity curve SF2 of the second formant F2, diagram 4*c* shows the sensitivity curve SF3 of the third formant F3, and diagram 4*d* shows the sensitivity curve SF4 of the fourth formant F4.

In the curves depicted in FIG. 4, the relative value of sensitivities SF1, SF2, SF3, SF4 with respect to each other has not been taken into account. Only the variation shape, signs, positions of maxima and minima and of the zero-crossings are of interest as far as the invention is concerned. A unit maximum value has thus been given to each of those sensitivities.

The theoretical shape of the formant sensitivity curves as a function of the position x where a section variation is applied is a sinus wave, the half wavelength of which is $L/(2i-1)$ where i is the formant rank where $i=1$ for the first formant F1; $i=2$ for the next resonance frequency ; and so on. The sine wave exhibits a minimum (maximum negative sensitivity) at the tube input (x 0) and a maximum (maximum positive sensitivity) at the tube output extremity ($x=L$).

The tube is antisymmetric, that is, an action upon the cross sectional area at a point of abscissa x acts upon the various formants exactly in the same way, but with an opposite sign, as an action upon the cross sectional area at an abscissa point L-x. Thus, for $x=L/2$ the action is null since the sensitivity crosses zero at this point for all formants regardless of rank. This antisymmetric feature is important since it will make it possible to limit the number of control parameters of the speech analyzing or synthesizing device. The same variation of formant frequencies is obtained for all the formants at the same time by acting upon the cross sectional areas at the abscissa point x instead of the abscissa point L-x, provided that one causes the cross sectional area to vary at that point in the opposite direction to the one that would have been used at point L-x.

The above explanations have been given based on a tube initially having a uniform cross sectional area portions of which are subjected to slight variations. Experiments carried out by the inventors have shown that, in the case of a tube divided into portions with variable cross sectional areas and in the case of major variations applied to those cross sectional areas, the directions of the variations are maintained even if the sensitivity functions are no longer sinusoidal.

The invention provides for dividing the tube into portions, the boundaries of which exactly correspond to the zero-crossings of the sensitivity of the formants with which a speech analyzing or synthesizing approximation is desired. Each zero-crossing determines the boundary of a portion.

The zero-crossings of the formant sensitivity are placed at the abscissae :

AO for the first formant F1
B1, AO, B'1 for the second formant F2
C1, C2, AO, C'2, C'1 for the third formant F3
D1, D2, D3, AO, D'3, D'3, D'2, D'1 for the fourth formant F4, and so on.

The values of those abscissae are as follows :

| | |
|---|---|
| A0 = L/2 | (middle of the tube) |
| B1 = L/6 | B'1 = L − L/6 |
| C1 = L/10 | C'1 = L − L/10 |
| C2 = 3L/10 | C'2 = L − 3L/10 |
| D1 = L/14 | D'1 = L − L/14 |
| D2 = 3L/14 | D'2 = L − 3L/14 |
| D3 = 5L/14 | D'3 = L − 5L/14 |

Three examples of division into portions according to the invention will now be given and then a general rule :

First example : an approximation with two formants F1 and F2 is desired.

Figure 5:
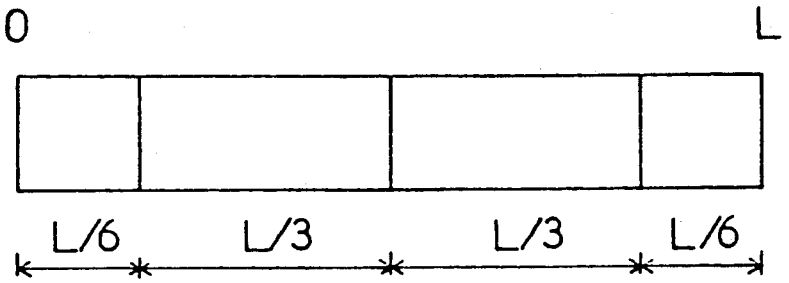
FIG. 5 shows the division of a tube into four portions according to the invention for an approximation limited to the first two formants.

The tube is divided into four portions as follows :
a first portion from O to B1 (length L/6)
a second portion from B1 to AO (length L/3)
a third portion from AO to B'1 (length L/3)
The corresponding tube is shown in FIG. 5.

Second example : an approximation with three formants F1, F2, F3 is desired.

Figure 6:
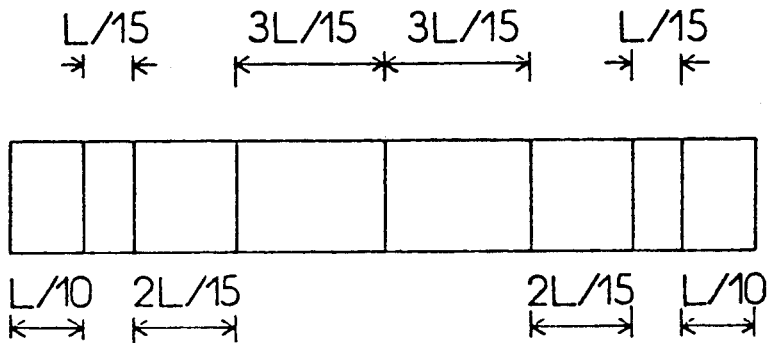
FIG. 6 shows the division of a tube into eight portions according to the invention for an approximation limited to the first three formants.

The tube is divided into eight portions as follows :
a first portion from 0 to C1 (length L/10)
a second portion from C1 to B1 (length L/15)
a third portion from B1 to C2 (length 2L/15)
a fourth portion from C2 to AO (length 3L/15)
and four additional portions symmetrical to the first four ones with respect to the middle of the tube.
The tube is illustrated in FIG. 6.

Third example : an approximation with four formants F1, F2, F3, F4 is desired.

Figure 7:
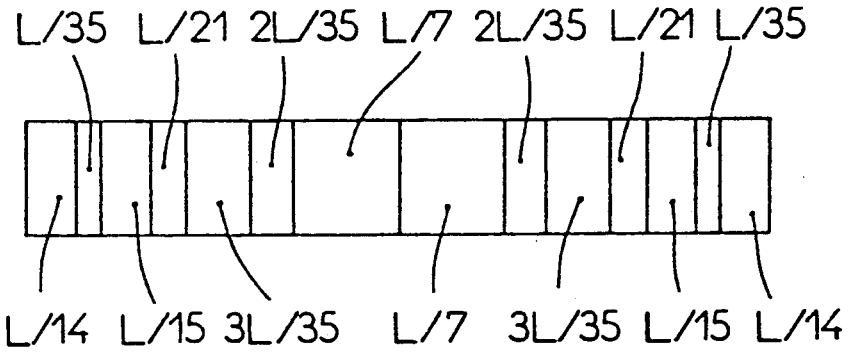
FIG. 7 shows the division of a tube into fourteen portions according to the invention for an approximation limited to the first four formants.

The tube is divided into fourteen portions, represented in FIG. 7, as follows :
a first portion from O to D1 (length L/14)
a second portion from D1 to C1 (length L/35)
a third portion from C1 to B1 (length L/15)
a fourth portion from B1 to D2 (length L/21)
a fifth portion from D2 to C2 (length 3L/35)
a sixth portion from C2 to D3 (length 2L/35)
a seventh portion from D3 to AO (length L/7)
and seven additional portions symmetrical to the first ones with respect to the middle of the tube.

To generalize the method to an n-formant approximation (though it is very unlikely it is desired to exceed $n=4$), one determines the abscissa $X_{i,j}$ of the $j^{th}$ zero-crossing of the ith formant sensitivity, for all the formants ($i=1$ to n) and on the whole length of the tube ($j=1$ to $2i-1$).

Then $X_{i,j}=L\,(2j-1)\,/\,(2i-1)\times 2$.

All the $X_{i's,j's}$ are classified according to ascending order along the tube at their respective positions. Each tube portion is delimited by two adjacent abscissae of the classified series, the first portion starting at abscissa 0 and ending at abscissa $X_{n,}=L/2n-1$ and the last portion starting at abscissa $X_{n,2n-1}=L-L/(2n-1)$ and ending at abscissa L. The overall number to position Is $N=n(n-1)+2$.

As explained a series of parameters for the operation of speech analyzing or synthesizing device can be accurately determined, those parameters being the number of portions and the length of each one. Those parameters are supplied to a computer and data processing consists of acting upon the cross sectional area of the portions determined by those parameters. The action can involve a number of portions equal to half of the net number, due to tube symmetry explained above.

Detailed analyses determines the cross sectional area variations required for each portion to produce the desired phoneme (for this purpose, the information already known on the formant frequencies and formant frequency variations corresponding to those phonemes is a useful guideline). A data memory associated with the computer, can store the variation sequences of the sectional areas of the determined portions.

In a speech synthesizing device, triggering of those variation sequences results, after processing by the computer, in generating electric signals transmitted to the loud-speaker and in producing the desired phoneme. In a speech analyzing device, a feedback process is used. A microphone receives sounds and converts them into electric signals. Those signals are processed by a computer. A comparison is carried out between the computer processed data and the data generated by the sequences of cross sectional area variations corresponding to already known sounds.

The invention can be used as a speech synthesis teaching game teach how sounds are produced by human vocal organs. In that case, the source is liable to be a mouthpiece comprising a reed in which the user will blow. It will also be possible to use a random noise source. Four or eight portions, the cross sectional areas of which are controlled by finger-operated pistons, will be used. The device can be plastic moulded.

We claim:

1. A speech synthesizer apparatus for producing an n-format speech approximation wherein n is a positive integer greater than 1, comprising:

a tube formed of a series of N tubular portions, wherein $N=2+n(n-1)$, each of said N tubular portions having a variable cross-sectional area, said tubular portions arranged end-to-end to comprise said tube wherein said tube has an overall length of L and boundaries between said portions are located at positions $X_{i,j}$ along the length L of said tube, wherein $X_{i,j}$ is defined as $$X_{i,j}=L(2j-1)/((2i-1)\times 2))$$

for $i=1$ to n and $j=1$ to $2i-1$; and means for exciting one end of said tube with an audible sound signal thereby causing a second audible signal to be emitted from the opposite end of said tube.

2. A speech synthesizer apparatus according to claim 1, wherein $n=2$, and wherein the tube is divided into $N=4$ portions, the successive lengths of which are L/6, 2L/6, 2L/6 and L/6, respectively.

3. A speech synthesizer apparatus according to claim 1, wherein $n=3$, and wherein the tube is divided into $N=8$ portions, the successive lengths of which are L/10, L/15, 2/15, 3L/15, 3L, 2L/15, L/15 and L/10, respectively.

4. A speech synthesizer apparatus according to claim 1, wherein $n=4$, and wherein the tube is divided into $N=14$ portions, the successive lengths of which are L/14, L/35, L/15, L/21, 3L/15, 2L/35, L/7, L/7, 2L/35, 3L/35, L/21, L/15, L/35 and L/14, respectively.

* * * * *